United States Patent [19]

Tissot

[11] 3,965,876

[45] June 29, 1976

[54] FUEL INJECTION PUMPS FOR INTERNAL COMBUSTION ENGINES

[75] Inventor: Raymond Tissot, Bron, France

[73] Assignee: Sigma Diesel, Venissieux, France

[22] Filed: Dec. 9, 1974

[21] Appl. No.: 531,197

[30] Foreign Application Priority Data

Dec. 13, 1973 France ..... 73.44650

[52] U.S. Cl. ..... 123/139; 123/139 AK; 123/139 AS; 123/139 AT

[51] Int. Cl.[2] ..... F02M 39/00

[58] Field of Search ..... 123/139 AT, 139 DP, 123/139 AZ, 139 AW, 139 AS, 139 AK

[56] References Cited

UNITED STATES PATENTS

| | | | |
|---|---|---|---|
| 1,993,759 | 3/1935 | Stockmeyer | 123/139 AS |
| 3,106,197 | 10/1963 | Mallory | 123/139 AT |
| 3,759,235 | 9/1973 | Vuaille | 23/139 DP |
| 3,762,386 | 10/1973 | Vuaille | 123/139 AK |

FOREIGN PATENTS OR APPLICATIONS

| | | | |
|---|---|---|---|
| 510,844 | 10/1930 | Germany | 123/139 DP |

*Primary Examiner*—Charles J. Myhre
*Assistant Examiner*—Paul Devinsky
*Attorney, Agent, or Firm*—Larson, Taylor & Hinds

[57] ABSTRACT

A fuel injection pump for an internal combustion engine has a pump assembly comprising a piston and cylinder and a structure defining a delivery passage through which fuel is delivered, during an active portion of a delivery stroke of the piston, from the cylinder to a linking passage connected to an injector. The structure also defines a return flow passage for the fuel between the linking passage and the cylinder. A normally closed delivery valve positioned in the delivery passage in alignment with the cylinder is responsive to pressure in the delivery passage to open during the active portion of the delivery stroke of the piston to allow fuel to be delivered to the linking passage. A normally closed return flow valve positioned in the return flow passage in alignment with the cylinder is responsive to the exceeding of a given pressure difference between the linking passage and the cylinder to open to allow fuel to flow back from the linking passage towards the cylinder, the return flow valve including a permanently open axial passage forming part of the delivery passage. A third valve is disposed in the delivery passage upstream of the return flow valve and is operative to open and close in the same sense as the delivery valve.

8 Claims, 2 Drawing Figures

FUEL INJECTION PUMPS FOR INTERNAL COMBUSTION ENGINES

BACKGROUND OF THE INVENTION

This invention relates to improvements in or relating to injection pumps for internal combustion engines of the kind comprising: a pump assembly including a cylinder and a piston reciprocable in said cylinder to deliver liquid fuel from said cylinder during an active portion of a delivery stroke of the piston; structure defining a delivery passage and a return flow passage for fuel between said cylinder and a linking passage for connection to an injector; a normally closed delivery valve positioned in the delivery passage in said structure in alignment with said cylinder and responsive to pressure in the delivery passage to open during the active portion of the delivery stroke of the piston to allow fuel to be delivered to the linking passage; and a normally closed return flow valve positioned in the return flow passage in said structure in alignment with said cylinder and responsive to the exceeding of a given pressure difference between the linking passage and said cylinder to open to allow fuel to flow back from the linking passage towards said cylinder; said return flow valve including a permanently open axial passage forming part of the delivery passage.

SUMMARY OF THE INVENTION

It is an object of the invention to improve injection pumps of this kind so that inter alia the pressure level produced upstream of the delivery valve upon discharge of the pressure wave due to the injector closing at the termination of injection can be better controlled.

Accordingly, the present invention provides, in an injection pump of the kind defined, a third valve disposed in said structure upstream of said return flow valve and operative to open and close in the same sense as said delivery valve.

A closed chamber is therefore formed downstream of the third valve at the completion of injection, and the pressure level produced in this closed chamber upon discharge of the return wave can be controlled through the agency of the third valve.

The third valve preferably comprises a movable valve member which is slidable in a bore forming part of the delivery passage and which is resiliently biased into a closed position with a valve head thereof against a seat at one end of the bore. The third valve is so devised that the bore begins to be closed when the valve head is at a predetermined axial distance from its seat and still has to move through such distance to take up its closed position against the seat.

Preferably, the valve member of the third valve comprises a shoulder or step of the same diameter as the bore in which it is received, the shoulder being adapted to close the bore, the valve head being frustoconical and the upstream end of the shoulder, such end controlling the start of closure of the bore, being separated axially from the part of the valve head which has the same diameter as the shoulder.

Advantageously, the axial distance is so chosen that the pressure produced in the closed chamber downstream of the third valve in the presence of the return wave due to the injector closing remains below a predetermined value of the order of 50 bars.

The delivery valve may comprise a ball retained on its seat by a spring, so as to reduce the axial dimension of such valve.

BRIEF DESCRIPTION OF THE DRAWING

In order that the invention may be readily understood, an embodiment thereof will now be described, by way of example, with reference to the appended drawing, in which.

DESCRIPTION OF A PREFERRED EMBODIMENT

Figure 1:
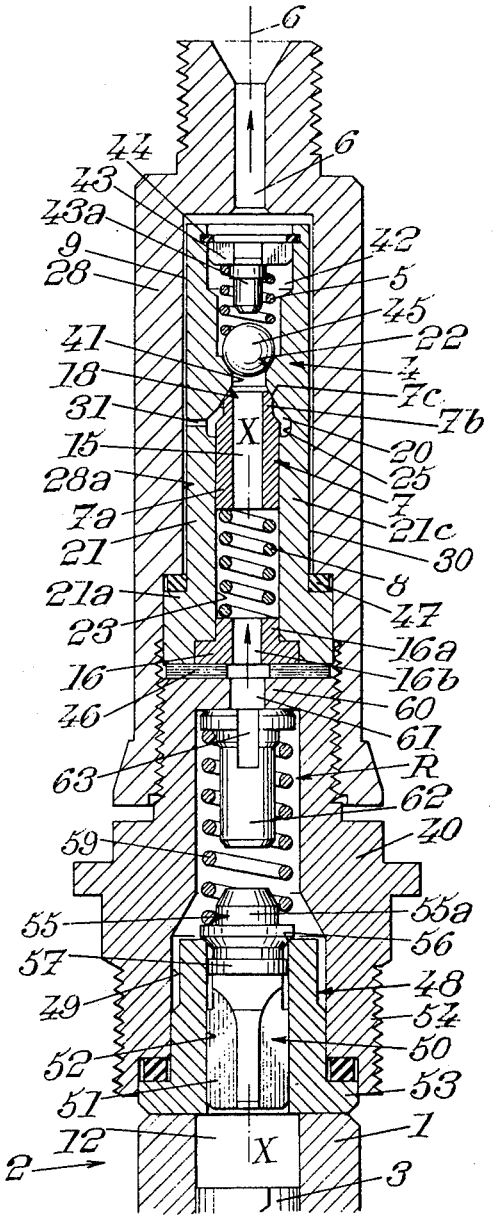
FIG. 1 is a view in diagrammatic axial section of the main elements of a fuel injection pump embodying the invention.

The illustrated injection pump comprises a pump assembly 2 including a piston 3 reciprocable in a cylinder 1. Downstream of the pump assembly 2 (the direction of flow being indicated by arrows in FIG. 1), there is provided a delivery valve 4 which is biased closed by a spring 5 and is adapted to open during an active portion of the delivery stroke of the piston 3 to allow liquid fuel to flow through a linking passage 6 to an injector (not shown). Upstream of the delivery valve 4, there is provided a return flow valve 7 which is biased closed by a spring 8 and is adapted to open to allow fuel to flow back towards the cylinder, through a passage 9 when the difference in pressure between the passage 6 and the cylinder 1 exceeds a predetermined value.

As regards the pump assembly, inter alia in connection with fuel intake into cylinder 1, reference can be made for more information to U.S. Pat. Specification No. 3,762,386.

The return flow valve 7 is disposed upstream of the delivery valve 4 in a structure defining delivery and return flow passages, and the valves 7 and 4 are both aligned with the pump cylinder 1 on the axis X—X of FIG. 1.

Valve 7 has a constant cross-section axial passage 15 which is permanently open and through which fuel delivered from pump cylinder 1 or more accurately from working chamber 12 can flow to delivery valve 4.

The two valves 4 and 7 are received in a hollow unitary member 21 which is formed with seats 22 and 18 for the respective valves 4 and 7 and which is positioned at the end of a connecting sleeve 40. Member 21 is formed internally and in the normal direction of fuel flow with: a cylindrical recess 23; a groove 25 forming the outer boundary of a chamber 20; the seat 18 of valve 7; a cylindrical bore 41 whose diameter is the same as the smallest diameter of seat 18; the seat 22 of delivery valve 4; and a recess 42 receiving spring 5 of delivery valve 4. At the end remote from bore 41, spring 5 is in abutting relationship with a crosspiece 43 which has a finger **43*a* engaging in spring 5 and serving to guide the same. Crosspiece 43 abuts an open resilient ring 44 anchored in a groove in the wall of recess 42. Crosspiece 43** is formed with apertures providing a large flow crosssection for the fuel.

Advantageously, the valve member of the valve 4 is a ball 45 and its seat is a frustoconical surface which widens towards the passage 6.

The return flow valve 7 and its seat 18 are made by the techniques used to make injectors. Correspondingly, valve 7 comprises a valve member having a guide portion **7*a* with external diameter which, except for the necessary operating clearance, is the same as the diameter of the recess 23. At the end of the valve 7 nearest the seat 18, the valve member comprises a cylindrical portion 7***b*, whose external diameter is less than the external diameter of portion 7*a*, and a frustoconical portion 7*c* cooperating with the seat 18 which is shaped to conform to the shape of portion 7*c*. The passage 15 of constant cross-section extends over the whole axial length of valve 7. To facilitate fuel flow, the spring 8 is a helical spring which is received upstream of valve 7 in the recess 23 between the same and a dished or domed washer 16 having a flange retained in an annular recess at the end of member 21, washer 16 being clamped between the same and a sealing ring or the like 46 which is in turn clamped between washer 21 and sleeve 40. Washer 16 has an extension 16*a* which is of smaller external diameter than the diameter of the flange and which engages in recess 23. The turns of the spring 8 are disposed outside the extension of the axial passage 15 and the washer 16 has an axial passage 16*b* which is in alignment with passage 15 and whose diameter is at least equal to the diameter of passage 15.

The unitary member 21 is received within a recess 28*a* in a tubular connector 28 and comprises a shoulder or step 21*a* which is clamped between sleeve 40 and the tubular connector 28. That end of the connector 28 which is near sleeve 40 has internal screwthreading cooperating with external screwthreading on sleeve 40 to hold the shoulder 21*a* captive.

Beyond the shoulder 21*a* the member 21 has a cylindrical portion 21*c* whose outer diameter is less than the diameter of the recess 28*a* in the member 28, so as to leave outside the portion 21*c* a free annular gap 30 which extends axially as far as a sealing ring 47 which is axially compressed between a transverse abutment surface presented by the shoulder 21*a* of the member 21 and a corresponding abutment surface formed in the connector 28 between the recess 28*a* and a larger diameter bore which is open towards the sleeve 40.

Substantially half-way along the axial length of annular chamber 30 there is at least one radial passage 31 formed in the member 21 and serving to connect the gap 30 to the chamber 20. The bypass passage 9 is embodied by that part of the gap 30 which is downstream (as considered in the normal flow direction) of the radial passage 31, by the chamber 20 and by the seat 18.

A third valve 48 which is adapted to open and close in the same sense as the delivery valve 4 is disposed upstream (as considered in the normal direction of flow) of the valve 7. A chamber R is therefore provided downstream of the valve 48 and the passage 9 which bypasses the delivery valve 4 extends to the chamber R.

As can be seen in FIG. 1, valve 48 is disposed in a recess 49 inside sleeve 40. Valve 48 has a valve member 50 formed with a guiding stem 51 of cruciform cross-section (not visible). The outside surface of the arms of the stem 51 cooperate with the inside surface 52 of a cylindrical bore in a sleeve 53 which is secured to cylinder 1 by means of a thimble or socket (not shown) adapted to cooperate with the externally screwthreaded portion 54 of sleeve 40.

Figure 2:
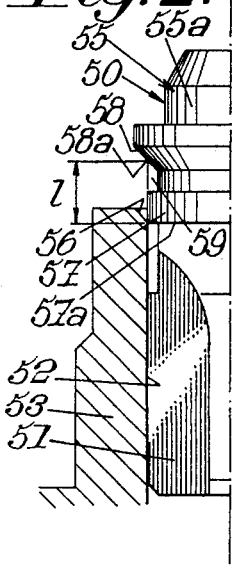
FIG. 2 is a detail of FIG. 1 on an enlarged scale.

When the top 55 of valve member 50 is off its seat 56, fuel can flow from the cylinder 1 through the valve 48 via recesses formed in stem 51 between its arms. As can be seen in FIG. 2, valve member 50 is so devised that bore 52 is closed when member 50 is at an axial distance *l* from its seat 56, the member 50 travelling through the distance *l* from the position shown in FIG. 2 to take up the fully closed position in which the member 50 bears on seat 56. Accordingly, the valve member 50 has, with advantage, downstream of stem 51 a cylindrical shoulder 57 of the same diameter as bore 52 and adapted to close the same. Member 50 also has an abutment flange 58 which has inter alia a frustoconical surface which tapers towards the cylinder 1. The frustoconical surface of flange 58 is adapted to cooperate with seat 56 which complements the flange 58.

When the valve 48 is in its fully closed position, flange 58 bears on seat 56. In the embodiment shown in the drawing, a groove 59 separates shoulder 57 from flange 58; in a variant the groove 59 can be omitted and the shoulder 57 can be extended as far as flange 58. In any case, the bore 59 starts to be closed, during the return movement of valve member 50 towards its closed position, when the more upstream edge 57*a* (visible in FIG. 2) of shoulder 57 enters bore 59 near the narrowest portion of seat 56. The distance *l* is the distance separating edge 57*a* from the flange portion 58*a* which is of the same diameter as the outer diameter of shoulder 57. Advantageously, the distance *l*, which determines the increase in the volume of the chamber R between the start of the closure of bore 57 by valve 50 and the termination of such closure (when flange 58 is in bearing engagement with seat 56), is such that the pressure produced in the closed chamber R downstream of valve 50 during the reflected pressure wave produced by closure of the injector, as will be explained hereinafter, stays below a predetermined pressure of the order of 50 bars.

Valve member 50 is biased on to its seat 56 by a helical spring 59 which bears at its other end on a shoulder 60 formed within sleeve 40, shoulder 60 serving to clamp gasket or seal 46. Shoulder 60 is formed with an axial passage 61 of which the diameter is at least equal to that of the passage 16*b*. The top 55 of valve member 50 has an extension 55*a* engaging in the terminal convolutions of spring 59, the other end thereof extending around a finger which, by way of a head, abuts shoulder 60. Finger 62 is formed with axial grooves 63 through which fuel can flow. As the foregoing description and the drawings show, valve member 50 opens in the direction enabling fuel to flow from cylinder 1 to the injector and closes in the opposite direction. The injection pump according to the invention as described operates as follows:

Injection occurs when, during the delivery stroke of plunger 3, the pressure in chamber 12 becomes high enough to open the valve 48 and then the delivery valve 4 and the injector. The fuel from chamber 12 flows through the grooves 63 and then through the axial passages 61, 16*b*, 15 to reach the high-pressure linking passage 6.

Upon the completion of injection when the pressure in chamber 12 decreases, the delivery valve 4 closes, and with it the injector (not shown) at the end of the passage 6. The closure of the injector produces a pressure wave in passage 6. Since valve 4 is in the closed state, the pressure wave, which takes the form of a pressure increase, is propagated through the bypass passage 9 and, if the pressure difference between the chamber 12 and the passage 6 is sufficient, opens valve 7 against the force of spring 8, so that fuel can return from passage 6 to chamber R. The same is isolated from chamber 12 by valve 48 whose valve member, urged by spring 59 and by the return pressure wave, has engaged with its seat 56. The pressure produced in chamber R depends upon the distance *l* previously referred to.

The system described can provide substantially constant deliveries per stroke, i.e., substantially constant volumes of fuel injected per pump shaft revolution, whatever the speed at which the same rotates, for a given position of a member (such as a rack) controlling the delivery per stroke by controlling the angular position of plunger 3 about its axis.

I claim:

1. A fuel injection pump for an internal combustion engine, comprising:

a pump assembly including a cylinder and a piston reciprocable in said cylinder to deliver liquid fuel from said cylinder during an active portion of a delivery stroke of the piston;

structure defining a delivery passage and a return flow passage for fuel between said cylinder and a linking passage for connection to an injector;

a normally closed delivery valve positioned in the delivery passage in said structure in alignment with said cylinder and responsive to pressure in the delivery passage to open during the active portion of the delivery stroke of the piston to allow fuel to be delivered to the linking passage; and a normally closed return flow valve positioned in the return flow passage in said structure in alignment with said cylinder and responsive to the exceeding of a given pressure difference between the linking passage and said cylinder to open to allow fuel to flow back from the linking passage towards said cylinder;

said return flow valve including a permanently open axial passage forming part of the delivery passage;

in which pump the improvement comprises;

a third valve disposed in said structure upstream of said return flow valve and operative to open and close in the same sense as said delivery valve, said third valve comprising a movable valve member slidable in a bore forming part of the delivery passage in said structure, a valve head on said movable valve member, a valve seat formed at one end of the bore receiving said movable valve member, and resilient means biasing the movable valve member into a closed position in which said valve head engages said valve seat, said movable valve member including means for closing the bore receiving said valve member when said valve head is spaced at a predetermined axial distance from said valve seat such that said movable valve member continues movement in a closing direction after closing of said bore, and hence increases the closed volume of the delivery passage downstream of the third valve until the valve head seats on said valve seat.

2. A pump as claimed in claim 1, wherein said movable valve member is formed with a shoulder dimensioned to slide in and close the bore receiving said valve member, the upstream end of said shoulder being axially spaced from said valve head.

3. A pump as claimed in claim 2, wherein said valve head is frustoconical and the upstream end of said shoulder is axially spaced by the predetermined axial distance from the part of said valve head which has the same diameter as said shoulder.

4. A pump as claimed in claim 1, wherein said structure defines a chamber downstream of said third valve, the predetermined axial distance between said valve head and said valve seat being dimensioned so that the pressure produced in said chamber in the presence of a return flow of fuel remains below a predetermined value of the order of 50 bars.

5. A pump as claimed in claim 1, wherein said structure comprises:

a first sleeve housing said third valve and positioned in axially abutting relationship with said cylinder;

a second sleeve receiving said first sleeve at one end thereof;

a unitary member housing said delivery valve and said return flow valve; and a connector which houses said unitary member and into which the other end of said second sleeve is screwed.

6. A pump as claimed in claim 1, wherein said structure comprises:

a unitary member housing said delivery valve and said return flow valve, said unitary member being formed at one end with a recess;

said delivery valve comprising a ball, a seat for said ball, a resilient ring anchored in the wall of the recess in said unitary member, a crosspiece retained in the recess by the resilient ring, and a spring positioned between the ball and the crosspeice to bias the ball into engagement with its seat.

7. A pump as claimed in claim 1, wherein said return flow valve comprises:

a movable valve member formed with a permanently open axial passage of constant cross-section;

a bearing washer disposed upstream of said valve member in the delivery passage; and a spring arranged between said valve member and said bearing washer to bias said valve member into a position closing the return flow passage.

8. A pump as claimed in claim 1, wherein said structure comprises:

a connector formed with the linking passage and a recess communicating with the linking passage; and a unitary member received in the recess of the connector with clearance so as to define an annular space which extends substantially over the entire axial length of the unitary member and which is in communication with the linking passage, said unitary member housing said delivery valve and said return flow valve;

said unitary member defining a valve seat of said return flow valve, a return flow chamber adjacent to and downstream of the valve seat of the return valve, and radial passages connecting the return flow chamber to the annular space between the unitary member and the connector.

* * * * *